United States Patent [19]

Barcus

[11] Patent Number: 4,491,051

[45] Date of Patent: Jan. 1, 1985

[54] STRING INSTRUMENT PICKUP SYSTEM

[76] Inventor: Lester M. Barcus, 16226 Wayfarer La., Huntington Beach, Calif. 92649

[21] Appl. No.: 455,249

[22] Filed: Jan. 3, 1983

Related U.S. Application Data

[63] Continuation-in-part of Ser. No. 399,138, Jul. 16, 1982, abandoned, which is a continuation-in-part of Ser. No. 345,044, Feb. 2, 1982, abandoned, which is a continuation of Ser. No. 123,889, Feb. 22, 1980, abandoned.

[51] Int. Cl.[3] ..... G10H 3/00

[52] U.S. Cl. ..... 84/1.16; 84/1.14; 84/DIG. 24

[58] Field of Search ..... 84/1.14, 1.16, DIG. 24

[56] References Cited

U.S. PATENT DOCUMENTS 4,314,495 2/1982 Baggs ..... 84/1.16

*Primary Examiner*—Forester W. Isen

*Attorney, Agent, or Firm*—Albert L. Gabriel

[57] ABSTRACT

A string instrument pickup system sensitive to 360° of transverse string movement, which is substantially immune from microphonics, and which has a substantially equal or balanced response to all of the strings. In one form of the invention a piezoelectric transducer is compressively associated with vertical movement components of each string of the instrument, but is laterally offset from a centered position under the string for compressive association of the transducer also with the horizontal string movement components; and halves of the total piezoelectric transducer area are oppositely polarized so as to cancel out microphonics. In a modular form of the invention a plurality of the piezoelectric transducers are supported in an elongated array by means of a flexible body of electrically insulative material and a pliable outer wrapping of metal foil so that the transducer is conformable to distortions and deformations in string saddle and bridge elements of the instrument between which the modular pickup is compressed whereby the transducers are made substantially uniformly responsive to the strings. In a presently preferred embodiment a two-section split saddle and uneven transverse positioning of crystals relative to strings for each saddle section provide substantially uniform response to all of the strings; and in this embodiment extremely small crystal areas minimize capacitive signal deterioration, and transversely very short crystals improve transverse string vibration response for substantially 360° of transverse string movement sensitivity.

14 Claims, 18 Drawing Figures

FIG. 5
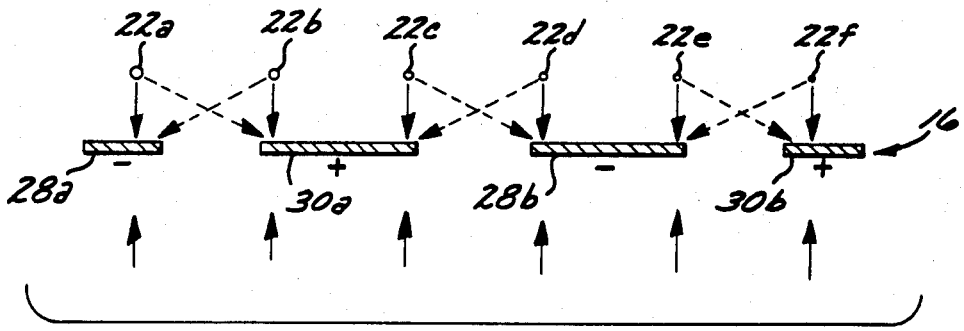
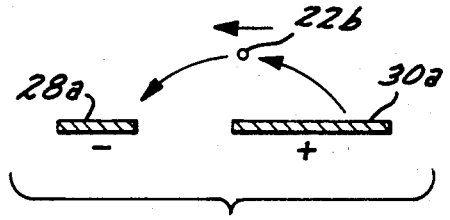
FIG. 6
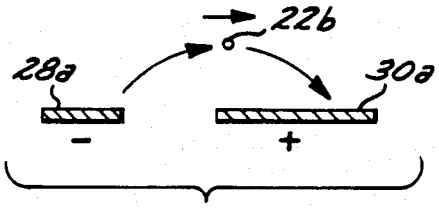
FIG. 7
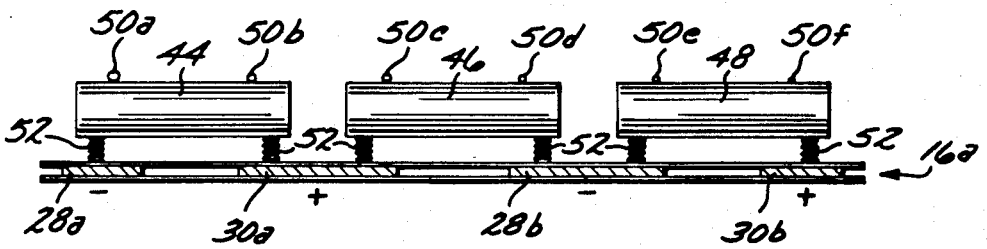
FIG. 8
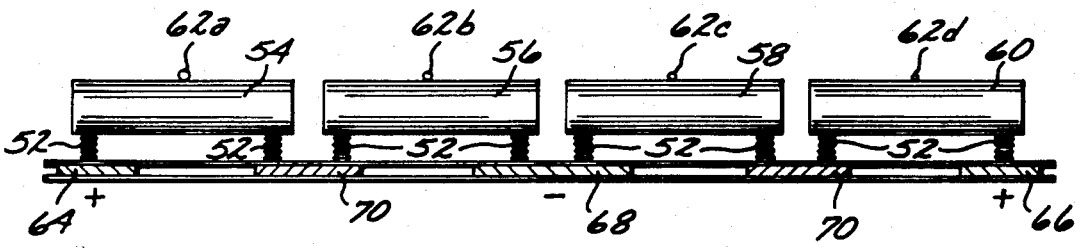
FIG. 9

STRING INSTRUMENT PICKUP SYSTEM

RELATED APPLICATIONS

This is a continuation-in-part of application Ser. No. 399, 138, filed July 16, 1982 for "String Instrument Pickup System", now abandoned, which was a continuation-in-part of application Ser. No. 345,044, filed Feb. 2, 1982 bearing the same title, now abandoned, which in turn was a continuation of application Ser. No. 123,889, filed Feb. 22, 1980, now abandoned, also bearing the same title.

BACKGROUND OF THE INVENTION

1. Field of the Invention

The present invention is in the field of string instrument pickup transducers, and the invention relates more particularly to pickups of the type employing piezoelectric transducers that are in direct compressional association with the instrument strings.

2. Description of the Prior Art

Electromechanical transducers or pickups are widely employed in connection with string musical instruments, and particularly in connection with both acoustic and "solid body" types of guitars. Many of these prior art pickups are directly related to the strings of the instrument in an endeavor to reproduce the true sounds of the strings, and these include both wound coil magnetic pickups which are primarily employed in the "solid body" type guitars known as "electric guitars", and piezoelectric crystal pickups which are typically provided in the form of a separate crystal compressed under each string proximate the bridge of the instrument.

A basic defect of all of these prior art pickups that are directly related to the strings of the instrument is that they are not fully responsive to vibratory movements of the strings in all directions transverse to the lengths of the strings, i.e., 360° of transverse string movement. Thus, the conventional wound coil magnetic pickup is responsive primarily only to vertical movements of the strings, and hence is generally non-responsive to the attack which is horizontal in both plectrum and bowed instruments. Similarly, most piezoelectric crystal pickups are also responsive only primarily to vertical movements of the strings, and thereby also substantially fail to respond to the initial attack. Failure of these conventional magnetic and piezoelectric pickups to adequately respond to horizontal or lateral string movements results in an incomplete electrical reproduction of the sonic information generated by the strings, resulting in generally poor fidelity; and in the case of piezoelectric pickups results in such generally low amplitude as to require the use of a preamplifier in advance of the usual amplifier system.

Another problem caused by the vertical sensitivity of conventional piezoelectric crystal pickups is that the pickups also sense vibrational and compressional information in the Helmholtz resonator body of an acoustic instrument, and accordingly the pickups are highly sensitive to various types of "microphonics" or body noises, including acoustic feedback, cross feed from other instruments and other performers' voices, finger and chord noises, and various impacts against the instrument.

Wound coil magnetic pickups have the further disadvantage that they are highly sensitive to stray electrical signals, such as "hum" from stage lighting and other electrical equipment; and many piezoelectric crystal pickups have a similar problem. Wound coil magnetic pickups have the further problem of requiring special strings of magnetic material which are generally inferior in sound to conventional strings.

Examples of typical prior art United States patents disclosing piezoelectric crystal pickups, which employ a separate crystal for each string, are Evans U.S. Pat. No. 3,080,785, Evans U.S. Pat. No. 3,154,701, Scherer U.S. Pat. No. 3,396,284, and Scherer U.S. Pat. No. 3,530,228. The crystals in these patents are responsive primarily to vertical string movements, and horizontal string movements cause a rolling or push-pull action in which one side of each crystal tends to be raised and the other side lowered so as to cancel out horizontal string information.

Various prior attempts have been made to minimize or avoid microphonics or body noises, including isolation of the crystals from the instrument body by vibrationally "dead" supports as in Rickard U.S. Pat. No. 3,712,951, and minimizing the mass of each piezoelectric element as in Evans U.S. Pat. No. 3,073,203. Evans U.S. Pat. No. 3,137,754 seeks to eliminate microphonics by having half of the individual string crystals reversely polarized, but this approach remains sensitive primarily only to vertical string movements and generally insensitive to horizontal string movements. Benioff U.S. Pat. No. 2,222,057 and Scherer U.S. Pat. No. 3,453,902 seek to avoid microphonics by centering each string above a pair of oppositely polarized piezoelectric elements, but this completely eliminates sensitivity of the transducers to vertical string movements and renders them sensitive only to horizontal string movements. Barcus et al U.S. Pat. No. 3,325,580 employs a rocking action of a tall violin bridge in association with a pair of oppositely polarized piezoelectric crystals to avoid microphonics, but as with Benioff and Scherer, this causes cancellation of signals from vertical string vibrations and renders the crystals sensitive primarily only to lateral or transverse vibrations of the strings.

Applicant is aware of no prior art magnetic or piezoelectric transducer directly associated with the strings of a string instrument which has good sensitivity to both vertical and transverse horizontal string movements, and which is therefore fully sensitive to 360° of transverse string movement; while at the same time is substantially completely insensitive to acoustic feedback, body noises, cross feed and other types of microphonics.

Baggs U.S. Pat. No. 4,314,495 encases a series of piezoelectric transducers in a unitary saddle member, and has a form (FIGS. 8 and 9) which he refers to as a "two dimensional" embodiment in which two separate series of the transducers are orthogonally related for sensing "two components of vibratory motion." The trouble with this is that his added set of crystal plates 78 is so arranged as to be able to sense only primarily components that are longitudinal of the string lengths, not lateral, so that they do not cooperate with the principal crystal bar 30 toward 360° of transverse string vibratory movement. Also, while Baggs does alternate the crystal polarities to reduce soundboard noises, he has 2-⅔ times as much crystal area of one polarity than the other in his crystal bar 30, and twice as much in his added set of crystal plates 78, so cancellation of soundboard noises would not be effective.

Another problem in the art of piezoelectric transducers for string instruments is that prior art efforts to modularize or unitize a plurality of piezoelectric crystals into a single structure for convenience of installation and marketing generally resulted in a rigid structure that would not conform to distortions in the bridge and saddle elements of the instrument caused by string tensioning or other factors, so that the pickup tended to not be uniformly responsive to each of the strings, and shimming was sometimes required to improve uniformity. Baggs U.S. Pat. No. 4,314,495 is an example of such prior art modularization. Such prior art efforts toward modularization or unitization of piezoelectric transducers for string instruments had the further problem that the supporting and covering portions thereof were generally sonically incompatible with the materials of which the bridge and saddle elements were made, so that the pickup would tend to introduce a harshness or brittleness into the picked-up sound.

Almost all of the prior art piezoelectric string instrument pickups, particularly those designed for guitars, have followed the Evans approach of a separate crystal (or pair of crystals) for each string. These include Evans U.S. Pat. Nos. 3,073,203, 3,080,785, 3,137,754 and 3,154,701; Sherer U.S. Pat. Nos. 3,396,284, 3,453,920 and 3,530,228; Benioff U.S. Pat. No. 2,222,057; and Rickard U.S. Pat. No. 3,712,951. However, most players have continued to insist upon a conventional, or at least a conventional-appearing, bridge saddle. This is undoubtedly partly because of tradition, but is believed also because the strings must be streched over a narrow, slightly curved surface like that found on the traditional saddle in order to vibrate properly for the proper acoustic effects. Accordingly, this approach of separate crystals for the individual strings has never been truly commercially successful, and is not currently used to any appreciable extent.

Prior art attempts to unitize or modularize the crystals into a saddle member as in Baggs U.S. Pat. No. 4,314,495, or to simply utilize a conventional or other unitary saddle over a series of crystals under the respective strings, have resulted in uneven responses to the strings due to the fact that the ends of the saddle were physically less constrained than the center part, resulting in greater vibratory movement, and hence response, for the end strings than for the center strings. Some help could be provided by shimming, but that is not a satisfactory solution to the problem. Thus, prior to the present invention there has never been a commercially acceptable guitar pickup associated with the bridge in which a traditional or traditional-appearing, saddle was utilized. Also, the larger the area of the crystals, the more difficult it was to get uniformity of response due to manufacting tolerance problems.

Conventional thinking regarding piezoelectric guitar pickups has always been that a relatively large area of piezoelectric transducers was required for good response. Applicant is not aware, however, of any useful prior art consideration of the possible effect of capacitive reactance of the crystals upon the performance characteristics. Applicant has found that typical prior art cumulative crystal transducer areas have a capacitive reactance that has a surprisingly large effect upon the response characteristics of the pickup, as to both amplitude and phase. This is particularly noticeable where only a single string is actuated, yet is adversely effected by the cumulative capacitive reactance of the crystals of all of the strings.

SUMMARY OF THE INVENTION

In view of these and other problems in the art, it is an object of the present invention to provide a string instrument pickup system that is highly sensitive to 360° of transverse string movement.

Another object of the invention is to provide a string instrument pickup system which is substantially completely insensitive to various types of microphonics, including acoustic feedback, instrument body noises, cross feed and the like.

Another object of the invention is to provide a string instrument pickup system which is substantially completely insensitive to extraneous electrical signals, such as those which typically cause a "hum" problem in prior art pickups.

Another object of the invention is to provide a unitary, elongated string instrument pickup containing a series of piezoelectric crystals and being adapted to be engaged between rigid bridge and saddle elements of the instrument, wherein the supporting and convering portions of the pickup are pliable and formable so that the pickup will conform to the engaging surfaces of the bridge and saddle elements despite deformations or distortions of the bridge and saddle elements caused by tensioning of the strings or other factors, whereby the pickup will be substantially uniformly responsive to each of the strings.

Another object is to provide a unitary, elongated piezoelectric string instrument pickup adapted for engagement between rigid bridge and saddle elements of the instrument, wherein the supporting and covering portions of the pickup are composed of materials that are sonically compatible with the materials of which the bridge and saddle elements are made, so that the pickup will capture the warm, wood, natural sound of the guitar without introducing any harshness or brittleness into the picked-up sound.

A further object of the invention is to provide a novel split saddle construction, and associated novel transverse string location relative to individual crystals associated with the respective strings, which produce substantially equal response characteristics for all of the strings despite the presence of a saddle of substantially conventional appearance and operation.

A further object of the invention is to provide a piezoelectric pickup particularly suited for use with a guitar wherein the cumulative crystal area is extremely small relative to the overall area under the bridge saddle so that the adverse effects of capacitive reactance are minimized and output is thereby greatly increased.

Yet a further object of the invention is to provide a piezoelectric pickup adapted for use with a guitar wherein the transverse dimension or length of each individual crystal associated with a respective string is so small as to substantially eliminate the cancellation effects of the rolling or push-pull action resulting from horizontal transverse string movements whereby most of the horizontal string information is transduced, and so that substantially uniform contacting of the crystals is enabled by a generally "point" type of saddle contact with the crystals.

A still further object of the invention is to provide a novel modular piezoelectric pickup for string instruments which is particularly simple in construction and is easy and economical to manufacture.

According to the invention, a series of spaced piezoelectric crystals is arranged, preferably in modular form, transversely under the strings of the instrument either in connection with the bridge of an acoustic instrument or the string adjusters of a 37 solid body" type instrument. The polarities of the crystals are such that half the size or area of the total amount of the crystals is polarized vertically in one direction, and the other half is polarized vertically in the opposite direction, so that substantially all microphonics are cancelled out.

In one form of the invention each string is compressively arranged above a crystal of one polarity and is widely laterally offset from a next adjacent crystal of opposite polarity, so that positive and negative vertical increments of compression are sensed by the crystal directly compressively related to each string, while there is minimal adverse response in the laterally offset next adjacent crystal of opposite polarity. At least a portion of the crystal that is directly compressionally related to each string is also laterally offset from that string so as to be sensitive to a rolling effect produced by horizontal movements of the string; and this rolling effect in some embodiments of the invention is also applicable to the next adjacent crystal of opposite polarity in an electrically additive manner.

The invention also comprises novel modular forms of the crystals which are substantially completely shielded against extraneous electrical signals and which enable generally conventional bridge and saddle members to be employed in acoustic string instruments, and generally conventional adjusters to be employed in "solid body" type string instruments.

A modular form of the invention employs a body of pliable material such as a calling card type of cardboard which has cut-out windows in which the piezoelectric crystals are located; utilizes soft copper sheet and foil stock for its electrodes; and is held together and electrically shielded by an outer wrapping of soft copper foil. This construction based upon pliable card stock and soft copper sheet and foil stock enables the pickup to conform to the engaging surfaces of the bridge and saddle elements between which it is compressed despite deformations or distortions of the bridge and saddle elements, resulting in substantially uniform response of the pickup to each of the strings. The soft copper has the additional unexpected functional advantage of being very sonically compatible with the materials of which the bridge and saddle elements are conventionally made, so that the full warm, woody, natural sound provided by the wooden instrument will be preserved in the electrical signals provided by the pickup.

In a presently preferred form of the invention the problem of unequal response between the outer and inner strings is overcome by means of a saddle that is split proximate its transverse center into two sections, half of the strings being engaged over each section. The response for the strings associated with each section of the split saddle is then further equalized by locating the end strings transversely less directly over their respective crystals than the center string is located over its respective crystal. In this form of the invention the response is greatly increased by having the cumulative area of the crystals extremely small, thereby minimizing the adverse effects of capacitive reactance of the crystals on amplitude and phase. In providing this extremely small overall crystal area, each crystal is made so short in its transverse dimension or length (i.e., in the direction of the length of the saddle) that the cancellation effects conventionally associated with the rolling or push-pull action resulting from horizontal transverse string movements are substantially eliminated.

BRIEF DESCRIPTION OF THE DRAWINGS

These and other objects of the invention will become more apparent in reference to the following description and the accompanying drawings, wherein:

FIGS. 5, 6 and 7 are diagrammatic views illustrating the mode of operation of the form of the invention shown in FIGS. 1, 2 and 4;

FIG. 8 is a diagrammatic view illustrating another form of the invention which is employed in connection with the string adjusters of a "solid body" type guitar having six strings;

FIG. 9 is a diagrammatic view similar to FIG. 8, showing a further form of the invention applied in connection with a "solid body" type guitar having four strings.

DETAILED DESCRIPTION

Figure 1:
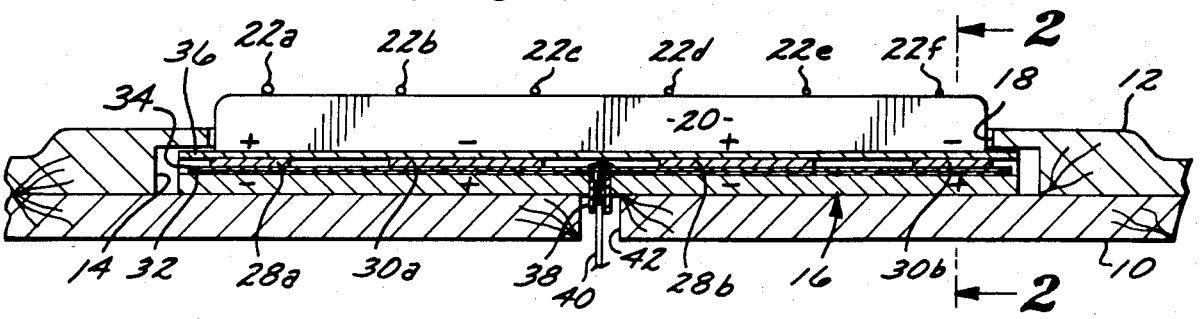
FIG. 1 is a fragmentary vertical section showing one modular form of the invention associated with generally conventional bridge and saddle members of an acoustic guitar, the section being taken transversely of the longitudinal axis of the instrument, and longitudinally through the bridge and pickup module of the invention.

FIGS. 1–4 of the drawings illustrate an embodiment of the invention employed in connection with a six-string acoustic guitar. The acoustic guitar has a top plate or soundboard 10 which is the generally flat, upper part of the Helmholtz resonator body of the guitar. A generally conventional-appearing bridge 12, which may be of wood, is affixed to the upper surface of top plate 10, and has a downwardly opening recess 14 therein, which may be routed out if the bridge 12 is of wood, the recess 14 being generally transversely located in the bridge 12 and having a generally rectangular cross section. An elongated pickup module 16 according to the invention is mounted within the recess 14 of bridge 12. Pickup module 16 is also of generally rectangular cross section, with its bottom surface seated against the top plate 10, and its top surface spaced slightly below the top of the recess 14 so as to not be subjected to any vertical compression forces other than those that are transmitted to the pickup module 16 through the saddle member described below.

Figure 2:
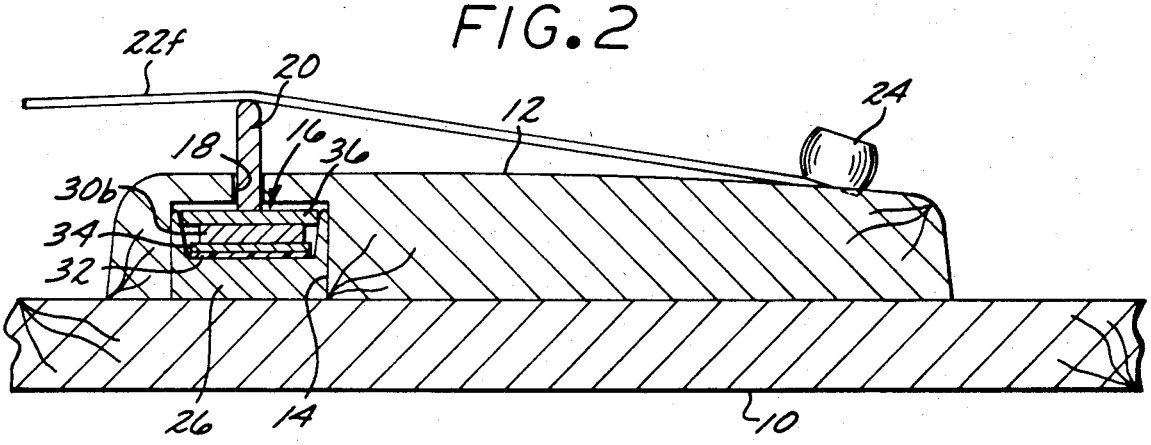
FIG. 2 is an enlarged cross section taken on the line 2—2 in FIG. 1.
Figure 3:
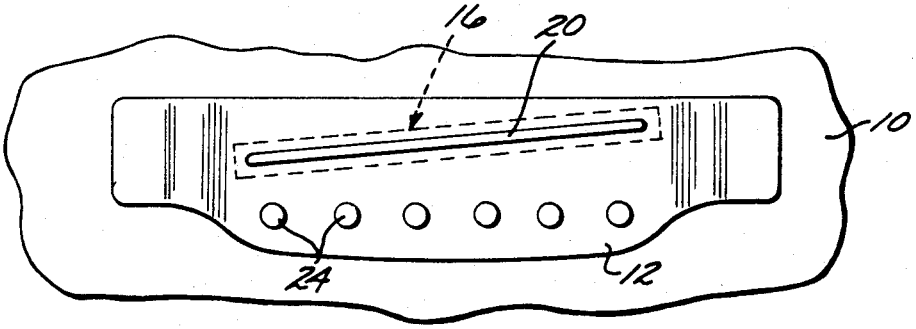
FIG. 3 is a fragmentary top plan view of the structure shown in FIGS. 1 and 2.
Figure 4:
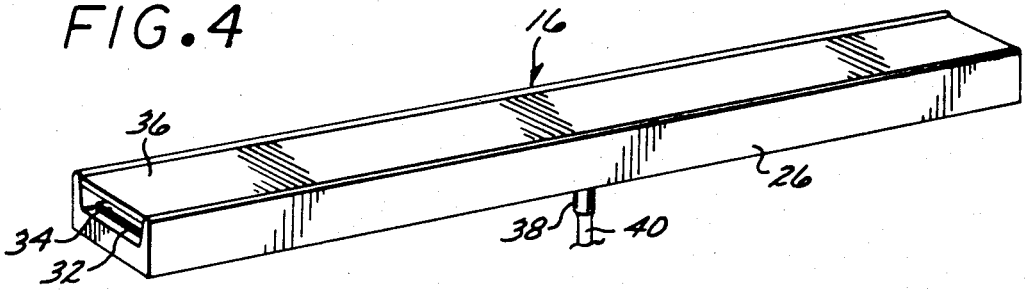
FIG. 4 is a perspective view of the pickup module shown in FIGS. 1 and 2.
Figure 10:
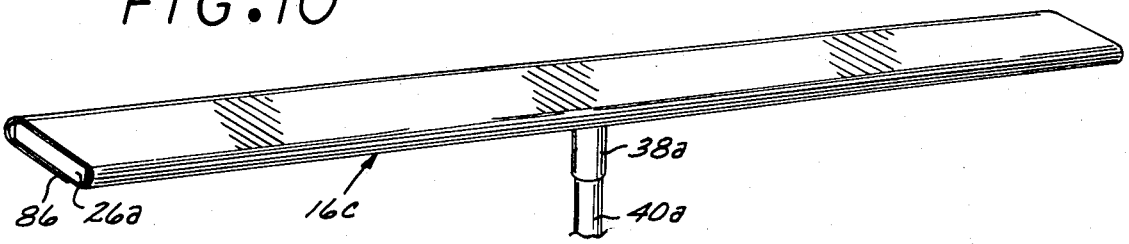
FIG. 10 is a perspective view showing another modular form of the invention.

A slot 18 extends upwardly from the recess 14 through the remaining upper portion of bridge 12 for receiving and locating a generally conventional saddle member 20 which is typically made of bone or plastic. The slot 18 is parallel to the recess 14, extending vertically upwardly from the crosssectional center of recess 14 as seen in FIG. 2, and the length of the slot 18 is slightly less than that of recess 14. The saddle member 20 is loosely engaged through the slot 18 so as to rest along its entire lower edge against the upper surface of pickup module 16, the loose fit of saddle 20 in slot 18 permitting transmission of compressional information from vibations of the strings of the instrument through the saddle member 20 to pickup module 16 without frictional interference from the bridge 12.

Six strings 22*a*–22*f* are stretched over the upper edge of saddle member 20 at approximately equally spaced locations and are connected to respective anchor pins 24. The summation of the downward forces of the strings 22*a*–22*f* applied through saddle member 20 against pickup module 16 places the pickup module 16 under a compressive mechanical biasing stress on the order of about 40 pounds.

In the modular form shown in FIGS. 1–4, the pickup module 16 includes an elongated body 26 in the form of a channel member of conductive material such as brass which serves as a generally rigid support base for the piezoelectric crystals employed in the pickup module 16, and which serves also as a ground conductor and electrical shield. Seated inside the channel member 26 in spaced relationship along the flat bottom of channel member 26 are four flat, elongated piezoelectric crystals 28*a*, 30*a*, 28*b* and 30*b*, each of which has the usual pair of electrodes on its flat surfaces and is responsive to pressure variations in the thickness mode. The two end crystals 28*a* and 30*b* are the same size as each other; while the two more centrally located crystals 30*a* and 28*b* are the same size as each other but are each twice as large as each of the crystals 28*a* and 30*b*. As seen in FIG. 2, all of the crystals have the same thickness in the vertical direction and the same width transversely of the channel member 26. As seen in FIG. 1, the difference in size or area of the crystals is provided by making them of different lengths along the channel member 26, so that each of the crystals 28*a* and 30*b* is half the length of each of the crystals 30*a* and 28*b*.

An important aspect of the various forms of the present invention is the transverse location of particular strings and pairs of strings relative to the respective crystals which they generally overlie. Thus, each of the end strings 22*a* and 22*f* is located directly over a respective end crystal 28*a* and 30*b*; while each of the end strings 22*a* and 22*f* is widely laterally offset from the next adjacent crystal 30*a* and 28*b*, respectively. In a similar manner, each of the pair of intermediate strings 22*b* and 22*c* is located vertically directly over the crystal 30*a*, whereas the strings 22*b* and 22*c* are widely laterally offset from the respective next adjacent crystals 28*a* and 28*b*. In the same manner, each of the intermediate strings 22*d* and 22*e* is vertically located directly over the crystal 28*b*, whereas the strings 22*d* and 22*e* are widely laterally offset from the respective next adjacent crystals 30*a* and 30*b*.

This array of crystals of different sizes and specific transverse locations of strings relative to the respective crystals which they overlie is combined with a reversing of the polarities of successive crystals in such a way as to provide high sensitivity pickup response to movements of each of the strings in all directions, including both horizontal and vertical components, while at the same time substantially completely cancelling out instrument body noises, acoustic feedback, cross feed from other instruments, and the like, which are cumulatively applied to the crystals through the top plate or soundboard 10 of the instrument.

Each of the crystals 28*a* and 28*b* and 30*a* and 30*b* has a definite polarity such that upon application of a positive increment of compression in the thickness mode a voltage differential will be produced between the opposite electrodes in one direction, while for a negative increment of compression in the thickness mode, an oppositely directed voltage differential will be produced between the electrodes. Thus, for a positive increment of compression, a first electrode of each crystal will go positive and a second electrode will go negative, while for a negative increment of compression the first electrode will go negative and the second electrode will go positive. Plus and minus signs are disposed adjacent opposite electrodes of each of the crystals of FIG. 1, and also in the corresponding diagrammatic illustration of FIG. 5, to indicate the polarities of the crystals corresponding to positive increments of compression. With the polarities alternating for the successive crystals 28*a*, 30*a*, 28*b* and 30*b*, it will be seen that the crystals 28*a* and 28*b* have one polarity in the vertical direction, while the crystals 30*a* and 30*b* have an opposite polarity in the vertical direction. The manner in which this serves to provide highly sensitive pickup response to all string directions of movement (i.e., 360° of string movement), while at the same time substantially completely eliminating response to cumulative forces applied to the crystals through the top plate 10, will be described hereinafter in detail in connection with FIGS. 5, 6 and 7.

The electrical connections to the piezoelectric crystal electrodes will now be described. A flat layer 32 of insulating material lines the upwardly facing flat bottom of channel member 26, and a hot conductor 34, which may be a metal foil such as copper foil, is supported on top of insulating layer 32 along most of the length of channel member 26. The bottom electrode of each crystal 28*a* and 28*b* and 30*a* and 30*b* is in full surface electrical contact with the hot conductor 34. A ground conductor 36, preferably of sheet metal such as brass, substantially completely covers the upper opening of channel member 26 for shielding purposes, and is in full surface interfacing electrical contact with the upwardly facing electrode of each of the crystals 28*a* and 30*a* and 30*b*. The ground conductor sheet 36 is electrically connected to the channel member 26, so that the members 26 and 36 provide a ground shield which completely surrounds the crystals and thereby effectively shields the crystals from any extraneous electrical signals such as 60 cycle hum from lighting equipment or other. As seen in FIG. 1, a ground tube 38 is fitted in a hole through the bottom of channel member 26, and the outer conductor of a coaxial cable 40 is electrically connected to this ground tube 38, and hence to channel member 26 and ground conductor sheet 36. The center conductor of coaxial cable 40 is electrically connected, as by soldering, to the hot conductor 34, thus completing the electrical circuit for the crystals. The ground tube 38 and coaxial cable 40 extend through an aperture 42 in top plate 10, the coaxial cable 40 then leading to suitable connection means such as the "end plug adapter" disclosed in U.S. Pat. No. 3,935,782 for connection to an amplifier. It is notable that the sensitivity and signal-to-noise ratio of the pickup 16 according to the present invention are so high that a preamplifier is normally not required.

FIGS. 5, 6 and 7 diagrammatically illustrate the mode of operation of the form of the invention shown in FIGS. 1–4. The plus and minus signs associated with the electrodes of the crystals in FIG. 5 indicate the polarities of the voltages established by positive increments of compression. Since the bottom electrodes of all four crystals are electrically connected to the hot conductor 34, it will be seen that for positive increments of compression, crystals 28*a* and 28*b* will produce negative voltage outputs to the conductor 34, while the crystals 30*a* and 30*b* will produce positive voltage outputs to the hot conductor 34. Conversely, for negative increments of compression, crystals 28*a* and 28*b* will produce positive voltage outputs to the hot conductor 34, while crystals 30*a* and 30*b* will produce negative voltage outputs to the hot conductor 34. Since the size or area of crystal 28*a* plus crystal 28*b* is equal to the size or area of crystal 30*a* plus crystal 30*b*, the voltage output of crystals 28*a* and 28*b* will cancel the voltage output of crystals 30*a* and 30*b* for any positive or negative increment of compression that is generally uniformly applied to all four crystals, as diagrammatically indicated by the upwardly directed, bracketed arrows in FIG. 5. Microphonics such as instrument body noises, acoustic feedback, cross feed from other instruments, and the like, produce such positive and negative increments of compression that are generally uniformly applied to all of the crystals, and are thereby substantially completely canceled out by the pickup module 16.

Nevertheless, the pickup module 16 is highly sensitive to both positive and negative increments of compression that are produced by both vertical and horizontal components of movement of each of the six strings 22*a*–22*f*, whereby the pickup module 16 is highly sensitive to 360° of movement of each of the strings 22*a*–22*f*. FIG. 5 illustrates how this sensitivity occurs for vertical components of movement of the strings which are indicated diagrammatically by a solid line vertical arrow associated with each string. Since each of the strings 22*a*–22*f* is directly above a portion of a respective crystal, vertical components of movement of each string will produce corresponding vertical increments of compression directly in the respective crystal to provide a corresponding electrical response. Thus, vertical components of movement of string 22*a* will produce such a direct electrical response in crystal 28*a*; each of the strings 22*b* and 22*c* will produce such direct electrical responses in crystal 30*a*; each of the strings 22*d* and 22*e* will produce such direct electrical responses in crystal 28*b*; and the string 22*f* will produce such a direct electrical response in crystal 30*b*.

However, each of the strings 22*a*–22*f* is only located proximate a single one of the crystals, and is widely laterally spaced from the next adjacent crystal which is of opposite polarity. This results in vertical increments of compression from each string being applied at an oblique angle to the next adjacent, oppositely polarized crystal as indicated by the dotted line arrows, which causes only a minor amount of signal cancellation.

FIGS. 6 and 7 illustrate the manner in which the pickup module 16 is sensitive to horizontal or lateral motions of the strings. String 22*b* and its lateral association with crystals 28*a* and 30*a* is shown as being representative, each of the other strings having a similar lateral association with a pair of the crystals. Lateral movements of the string produce a rolling or push-pull compressional and tensional effect on the pair of adjacent crystals which provides an additive electrical output. In order for this rolling or push-pull effect to be operative in the particular crystal above which the string is located, the string is located near one edge of the crystal, so that the crystal extends considerably laterally from the string. Thus, it will be noted from FIG. 5 that each of the strings is located near one edge of the particular crystal that it is directly above.

As seen in FIG. 6, movement of the string 22*b* to the left produces a positive increment of compression in the crystal 28*a* located to the left of string 22*b*, while at the same time producing a negative increment of compression (i.e., tension) in that portion of the crystal 30*a* which is located to the right of string 22*b*. Since crystal 30*a* is oppositely polarized from crystal 28*a*, this negative increment of compression in crystal 30*a* produces an electrical output that is additive to that of crystal 22*a* as indicated by the plus and minus signs associated with these crystals. Conversely, as seen in FIG. 7, movement of the string 22*b* to the right produces a positive increment of compression in the crystal 30*a* and a negative increment of compression (i.e., tension) in the crystal 28*a*, with resulting additive electrical outputs as indicated by the plus and minus signs which are opposite the electrical outputs for FIG. 6.

Thus, FIG. 5 diagrammatically illustrates how vertical string movements are sensed while microphonics are nevertheless canceled, and FIGS. 6 and 7 diagrammatically illustrate how horizontal string movements are sensed. Actually, such vertical and horizontal string movements may be vertical and horizontal components of string movements in any direction, so that the pickup module 16 is sensitive to all transverse directions of string movement, i.e., 360° of transverse string movement.

FIGS. 8 and 9 diagrammatically illustrate embodiments of the present invention employed in connection with non-acoustic or "solid body" string instruments typified by the "electric guitar" that usually employs wound magnetic pickups. FIG. 8 shows the invention applied to a six-string instrument of this type, and FIG. 9 shows the invention applied to a four-string instrument of this type.

Referring to FIG. 8, the pickup unit designated 16*a* has the same arrangement of piezoelectric crystals as the pickup module 16. Accordingly, the pickup unit 16*a* has end crystals 28*a* and 30*b* of half size, and intermediate crystals 30*a* and 28*b* of full size; the crystals 28*a* and 28*b* have one polarity, and the crystals 30*a* and 30*b* having an opposite polarity. In this form of the invention, the saddle member is replaced by three string adjusters 44, 46 and 48 over which the strings are stretched. String adjuster 44 carries the pair of strings 50*a* and 50*b*; string adjuster 46 carries the pair of strings 50*c* and 50*d*; and string adjuster 48 carries the pair of strings 50*e* and 50*f*. Each of the string adjusters has a pair of spaced, downwardly projecting adjustable legs 52, which may be screws.

A comparison between FIG. 8 and FIG. 5 shows that the strings 50*a*–50*f* are similarly located relative to the respective crystals as are the strings 22a–22f. The adjuster legs 52 of string adjuster 44 engage against the respective crystals 28a and 30a; the adjuster legs 52 of the string adjuster 46 engage against the respective crystals 30a and 28b; and the adjuster legs 52 of string adjuster 48 engage against the respective crystals 28b and 30b; and these engagements cause vertical and horizontal movements of the strings 50a–50f to apply the same increments of compression and tension to the crystals as described in detail hereinabove in connection with FIGS. 5, 6 and 7 for the movements of strings 22a–22f.

In the four-string "solid body" type instrument application of FIG. 9, four string adjusters 54, 56, 58 and 60 are employed, each having a pair of adjuster legs 52. Each of the four strings 62a–62d is centered on a respective string adjuster 54, 56, 58 and 60. The pickup unit 16b in this form of the invention embodies only three piezoelectric crystals, a pair of half size end crystals 64 and 66 which are polarized in one direction, and a full size center crystal 68 that is polarized in the opposite direction. Since crystal areas of opposite polarity are equal, the generally vertically oriented microphonics are substantially completely canceled out.

Disposed in the pickup unit 16b between each of the end crystals 64 and 66 and the center crystal 68 is a support 70. With each of the strings generally centered in its respective string adjuster, and adjuster leg 52 proximate one end of each adjuster engaged over one of the crystals while the adjuster leg proximate the other end of each adjuster is engaged simply over one of the supports 70 rather than a crystal, it will be seen that both vertical and horizontal movements of each string 62a–62d will be applied as increments of compression and tension to one of the crystals 64, 68 and 66 so that 360° of movement of each of the strings 62a–62d will be sensed by the crystals. Thus, vertical movements of string 62a will produce vertical compressional and tensional increments through the left-hand adjuster leg 52 of adjuster 54 to the crystal 64; vertical movements of the string 62 will apply vertical increments of compression and tension through the right-hand leg of adjuster 56 to the crystal 68; vertical increments of string 62c will apply vertical increments of compression and tension through the left-hand leg 52 of adjuster 58 to crystal 68; and vertical movements of string 62d will apply vertical increments of compression and tension through the right-hand leg 52 of adjuster 60 to crystal 66. Horizontal movements of the strings 62a, 62b, 62c and 62d will have rolling effects on the respective string adjusters 54, 56, 58 and 60 which will produce corresponding compressional and tensional effects for string 62a on crystal 64, for string 62b on crystal 68, for string 62c on crystal 68, and for string 62d on crystal 66. References herein to "tension" or "tensional" increments applied to the crystals have been employed for descriptive purposes, although it is to be understood that the relatively high compressional biasing of the crystals resulting from string tension makes the term "negative increments of compression" technically more accurate.

FIGS. 10–16 of the drawings illustrate another modular embodiment of the invention, generally designated 16c, which is compliable with bridge and saddle deformations, distortions and tolarance variations, both on an overall basis and relative to each of the individual crystals, so as to provide improved uniformity of response to each of the strings improved output signal amplitude for each crystal string combination, and wherein the supporting and covering materials of the pickup are particularly sonically compatible with the materials of which the bridge and saddle are made so as to preserve the warm, natural guitar sound in the electrical output of the pickup. The novel construction of the pickup module 16c is also particularly simple and economical to manufacture, and enables much closer manufacturing tolerances to be held then other forms of pickups.

Figure 12:
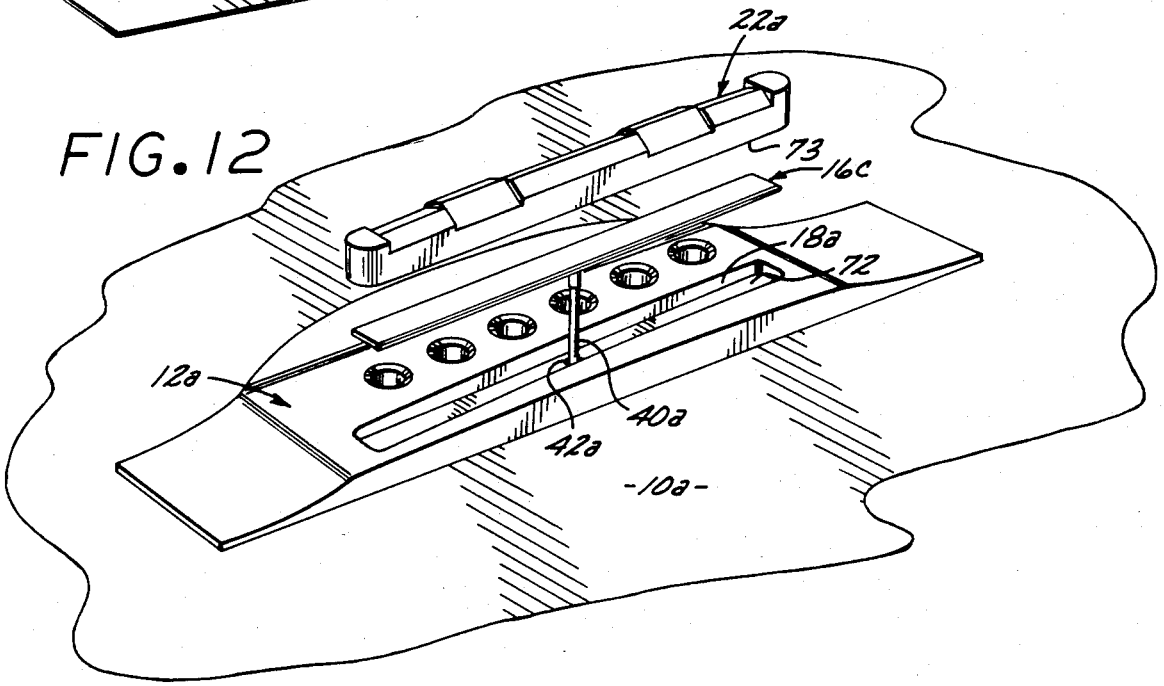
FIG. 12 is another exploded perspective view, showing the manner in which the assembled pickup of FIG. 10 is mounted in the instrument bridge under the saddle.
Figure 13:
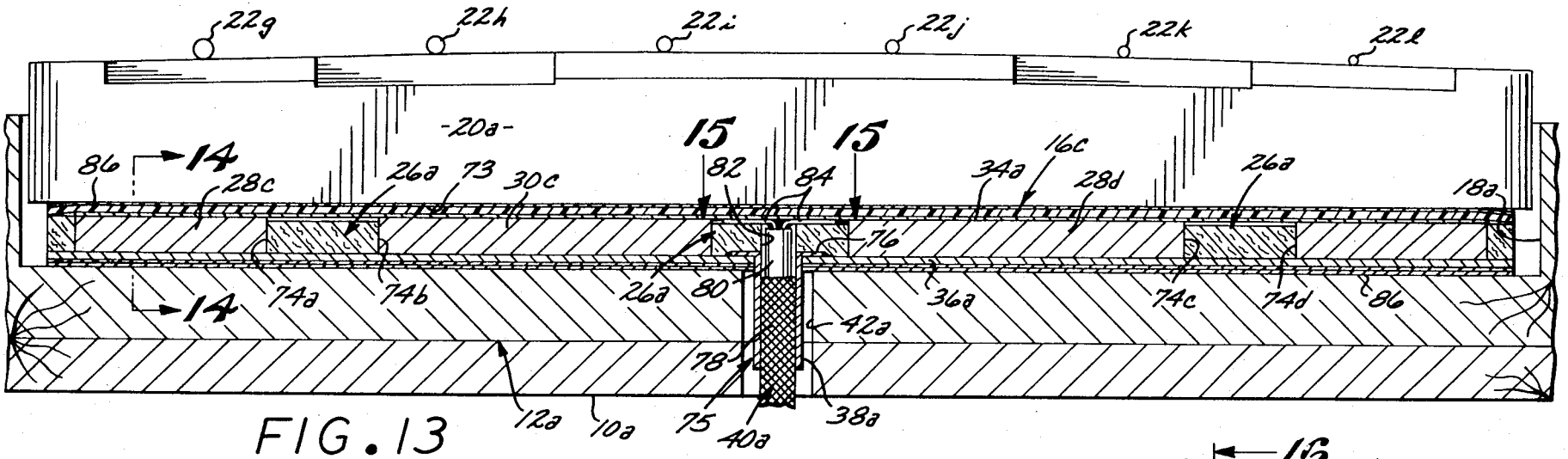
FIG. 13 is an enlarged fragmentary vertical section similar to FIG. 1, but illustrating details of construction of the modular form shown in FIGS. 10–12.

The illustrated embodiment of the pickup module 16c is particularly adapted to be fitted within a standard upwardly opening bridge groove for a compensated saddle, as illustrated in FIGS. 12 and 13. Such bridge groove, designated 18a in bridge 12a on guitar top plate 10a, is ¼ inch wide and a little less than 3 inches long, and is adapted to receive the lower portion of complementary-shaped compensated saddle 20a. Thus, when adapted for use in this type of bridge, the pickup 16c is preferably approximately ¼ inch wide and 2-¾ inches long. The pickup 16c seats against the upwardly facing bottom surface 72 of bridge groove 18a, and is clamped between the groove surface 72 and the bottom surface 73 of the saddle 20a under the cumulative compressive force of the tensional strings. This compressive force is generally in the range of from about 60–70 pounds, but may be as high as 80 pounds.

The pickup 16c may be made very thin in the vertical direction, as for example only about 0.041 inch thick, so that in most instances it will not even be necessary to alter the dimensions of the bridge 12a or saddle 20a to accommodate the pickup 16c. However, if it is desired to have the saddle height the same as without the pickup, 0.041 inch may be milled off of the bottom of the saddle 20a, or alternatively 0.041 inch may be routed out of the bottom of bridge groove 18a.

The pickup module 16c is, like the module 16 of FIGS. 1–7, adapted for use in a 6-string guitar, and has the same crystal array, polarization and mode of operation as described in detail hereinabove in connection with FIGS. 1–7. Thus, the individual strings 22g–22l relate to the individual crystals 28c, 30c, 28d and 30d in pickup 16c of FIGS. 10–16 in the same manner as the strings 22a–22f relate to the crystals 28a, 30a, 28b and 30b in the pickup 16 of FIGS. 1–7, both as to the positioning of the strings over the crystals and as to the manner in which the crystals cooperate with the strings to provide a high degree of sensitivity to 360° of string movements while at the same time providing substantially complete insensitivity to various types of microphonics, including acoustic feedback, instrument body noises, cross feed and the like.

The details of construction and assembly of the pickup module 16c will now be described in connection with FIGS. 11 and 13–16. A primary departure from prior art pickup modules in the construction of the present module 16c, which is helpful to its being compliable between the bridge and saddle elements is the use of a body member of insulating material that is pliable or flexible as the "backbone" of the pickup, and the use of a wrap-around metal foil covering that is also pliable or flexible to hold the assembled pickup together and at the same time electrically shield the sensing elements of the pickup instead of using a rigid metal casing to hold the module together and shield the sensing elements.

This "backbone" of the conformable module 16c is an elongated body 26a of pliable or flexible, electrically insulative material such as cardboard from calling-card stock. Cut-out windows 74a–d are provided through the vertical or thickness direction of the cardboard body 26a for receiving the respective crystals 28c, 30c, 28d and 30d, the windows 74a–d serving to accurately locate the crystals both laterally and longitudinally relative to the body 26a and hence relative to the strings 22g–22l, while at the same time allowing the crystals to "float" vertically relative to the body 26a to further the compliability of the individual crystals between the bridge and saddle elements. The crystals 28c, 30c, 28d and 30d are slightly thicker in the vertical direction than the body 26a so that the body 26a will not interfere with the direct compression of the crystals between the bridge and saddle elements under the influence of the strings. Thus, in the example referred to above that is about 0.041 inch thick, the crystals are preferably about 0.030 inch thick and the body 26a is preferably about 0.025 inch thick.

Figure 14:
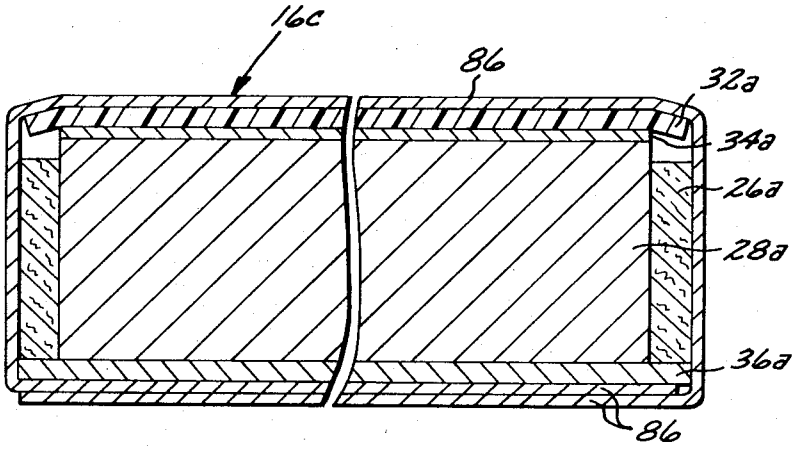
FIG. 14 is a cross-sectional view taken on the line 14—14 in FIG. 13, with a portion broken away.

In this form of the invention the upper crystal contact 34a is the "hot" conductor for the crystals. This may be a metal foil sheet preferably having the same width as the crystals and having its length slightly shorter than that of the body 26a, but extending to the outer ends of the end crystals 28c and 30d. In this way, the hot conductor foil 34a will have full surface contact with the conductive upper surface of each of the crystals, while nevertheless there will be substantial peripheral clearance between both the side edges and the end edges of the hot conductor 34a and the grounded wrap-around outer foil, described hereinafter, which holds the module 16c together and electrically shields it. This side clearance is seen in FIG. 14, and the end clearance is seen in FIG. 13. In the 0.041 inch thick module example, the hot upper crystal contact 34a is metal foil about 0.001 inch thick. Contact 34a is preferably made of soft copper foil, which applicant was found to be uniquely compatible sonically with the materials of which the bridge and saddle are conventionally made, such as rosewood or ebony for the bridge and bone or equally hard plastic for the saddle, while at the same time being very pliable or formable.

The lower crystal contact 36a in pickup module 16c is the ground contact for the crystals. This is a metal sheet or plate preferably extending to the full width and length of the elongated body 26a as seen in FIGS. 14 and 13, respectively, and being in full surface contact with the conductive lower surface of each of the crystals. The lower, ground contact sheet 36a is, like the upper, hot contact 34a, preferably made of soft copper for pliability or formability and for sonic compatibility with the bridge and saddle elements. However, the lower, ground contact sheet 36a is preferably much thicker and hence structurally much stronger than the upper, hot contact, to provide a secure mechanical and electrical terminal connection for the shielding of a coaxial cable output lead from the pickup module 16c. Thus, in the 0.041 inch thick module example, the ground contact sheet 36a is about 0.005 inch thick.

The terminal connection for the coaxial cable is provided by a grommet, generally designated 75, which includes a tube portion 38a having a flat annular flange 76 at its upper end. The grommet 75 is preferably made of a material, such as brass, which is both a good electrical conductor and strong mechanically. Grommet flange 75 overlies the ground conductor 36a and the tube portion 38a of the grommet extends downwardly through a central hole 77 in ground conductor 36a. The coaxial cable 40a extends upwardly through the grommet 75 with its grounded braided shielding 78 electrically and mechanically connected to the grommet tube 38a and terminating within the tube 38a, its insulator 80 extending upwardly past the flange 76 into a central hole 82 through body 26a, and the strands 84 of its center "hot" conductor spread out overlying the center portion of body 26 immediately underneath the hot upper conductor 34a. In the 0.041 inch thick example the grommet flange 76 is about 0.005 inch thick, and the coaxial cable center conductor strands 84 are about 0.007 inch thick and between 5 and 7 in number. The braided cable shielding 78 may be connected to the grommet tube 38a by soldering or by means of a conductive silver epoxy. Use of a teflon cable insulator will permit soldering without damage to the cable 40a.

Figure 15:
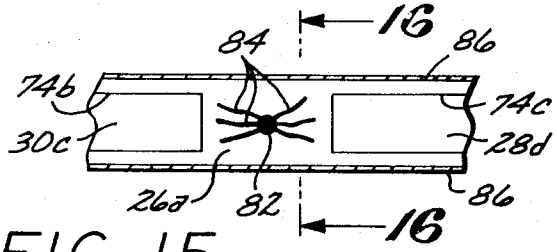
FIG. 15 is a fragmentary section taken on the line 15—15 in FIG. 13.
Figure 16:
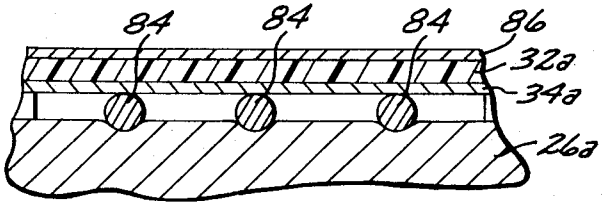
FIG. 16 is a greatly enlarged fragmentary section taken on the line 16—16 in FIG. 15.

With the fully assembled pickup module 16c under compression between the bridge and saddle elements as shown in FIGS. 13–16, the strands 84 of the center cable conductor will be tightly compressed by the body 26a against the hot upper conductor 34a as shown in FIGS. 13 and 16 to provide an excellent electrical connection therebetween, and the grommet flange 76 will be similarly tightly compressed by the body 26a against the lower ground conductor 36a to provide excellent electrical and mechanical connections therebetween. The electrically insulative material of the body 26a, such as calling-card cardboard, is not only flexible for general conformity between the bridge and saddle elements, but is also resilient or elastic in the vertical or thickness direction. This causes the body 26a to deform in the regions of the cable strands 84 and grommet flange 76, respectively and resiliently bias the strands 84 and flange 76 against the hot and ground conductors 34a and 36a, respectively, as shown in FIGS. 15 and 13, respectively.

The coaxial cable 40a extends downwardly through a hole 42a in bridge 12a and top plate 10a, the cable 40a then leading to suitable connection means such as the "end plug adapter" disclosed in U.S. Pat. No. 3,935,782 for connection to an amplifier.

A sheet 32a of electrical insulation material overlies the hot conductor sheet 34a so as to insulate the hot conductor 34a from the outer foil wrapping. Insulator sheet 32a is preferably coextensive with the body 26a, both longitudinally and laterally, so as to have a peripheral margin extending substantially beyond the hot conductor 34a all the way around the conductor 34a. The insulator sheet may be cellophane tape, and in the 0.041 inch thick example it is about 0.002 inch thick.

Figure 11:
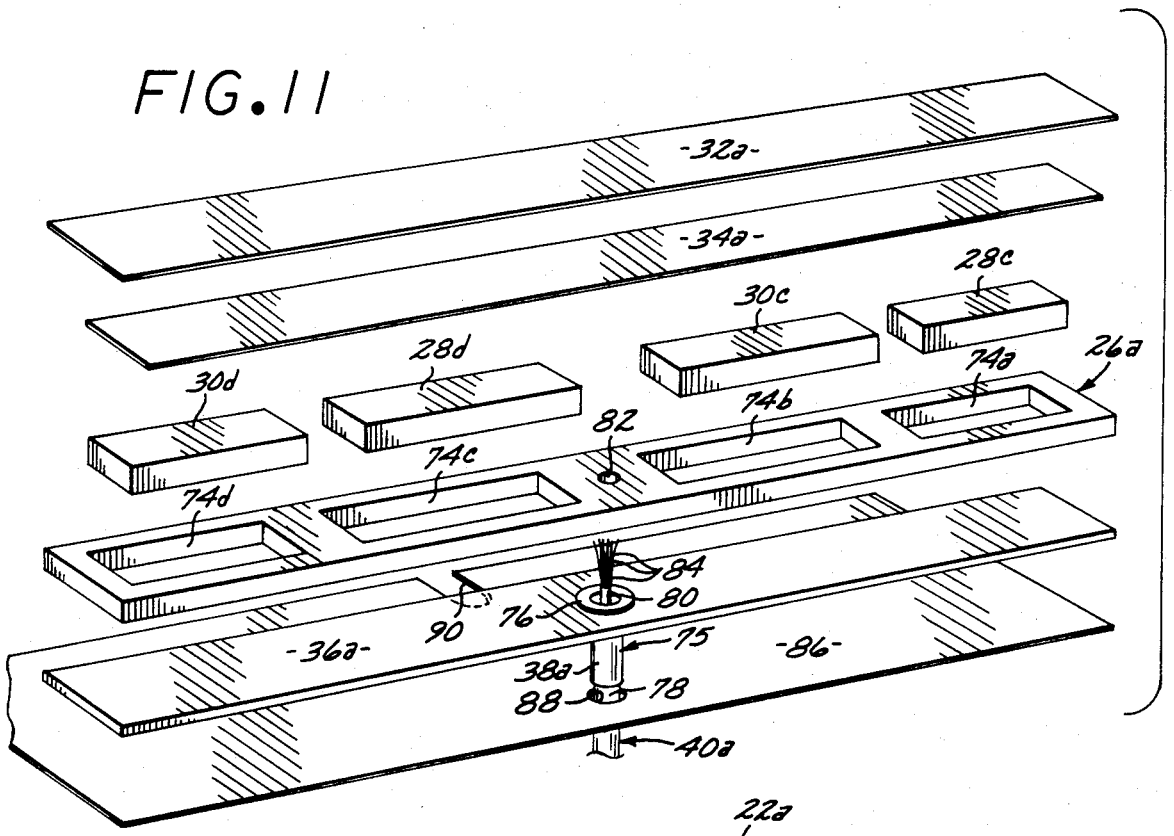
FIG. 11 is a fragmentary exploded perspective view of the parts of the modular pickup of FIG. 10 prior to assembly thereof.

The outer foil wrapping which both holds the pickup module 16c together and shields the electrical components therein against external electrical influence is, like the hot upper conductor 34a, preferably made of soft copper foil for overall pliability or formability of the pickup module 16c along its length and for pliability or formability in the region of each of the individual crystals, as well as for sonic compatibility with the bridge and saddle elements. The outer foil wrapping is generally designated 86, and is coextensive in length with the elongated body 26a. As shown in FIGS. 11 and 14, the foil of wrapping 86 has a first increment that lies flush against and is laterally substantially coextensive with the bottom of ground conductor sheet 36a. The tube portion 38a of grommet 75 extends downwardly through a hole 88 in this first increment of the foil wrapping 86. The foil wrapping then has successive increments which extend up over one side of the module (the left side of FIG. 14), flush over the top of the insulation sheet 32a, down over the other side of the module, and then flush against and substantially coextensive with the bottom of the first increment of the wrapping 86. A cutout 90 in the side edge of this final underlying increment of the foil wrapping, seen in FIG. 11, allows the grommet tube 38*a* to extend down therethrough. This final underlying increment of the outer foil wrapping is bonded to the first increment of the foil by a permanent adhesive, as for example by a permanent spray adhesive. In the 0.041 inch thick example of pickup module 16*c*, the foil of wrapping 86 is about 0.001 inch thick.

The construction of pickup module 16*c* with foil outer wrapping 86, foil upper conductor 34*a*, thin sheet lower conductor 36*a*, and cardboard "backbone", enables the manufacturing tolerance in the thickness direction to easily be held to within a 0.00025 inch tolerance, and this is within the natural creep adjustment of the bone or plastic saddle. In contrast, pickup modules having rigid housings may sometimes be as much as 0.005 inch out of tolerance.

The 0.041 inch thick foil-wrapped example referred to above has been found in operation to bow right along with bowing distortions of the bridge and saddle members when the strings are strung up and tensioned, eliminating any imbalances between the strings and avoiding any necessity to shim to get the strings picked up equally. The output amplitude for each string, and hence the overall amplitude of the output, was found to be greater for the 0.041 inch thick foil-wrapped example than for rigidly housed modular pickup units because of the individual compliance of the soft copper foil and sheeting over each crystal. Also, the tone quality of the 0.041 inch thick example is exceptional because of the compatibility of the soft copper foil and sheeting with the materials of the bridge and saddle, being aptly described as a preservation of the warm natural wood sound of the guitar bridge, as compared to a more harsh, brittle sound typically produced by a rigidly housed pickup module.

Figure 17:
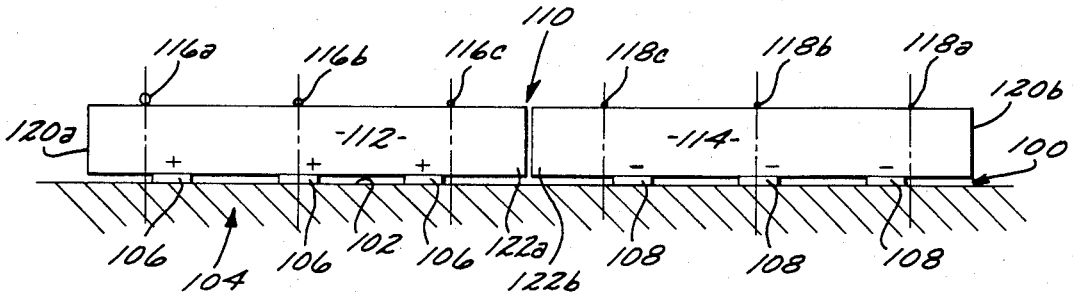
FIG. 17 is a fragmentary, diagrammatic transverse vertical section similar to FIGS. 1, 5 and 13 illustrating a presently preferred split-saddle form of the invention.
Figure 18:
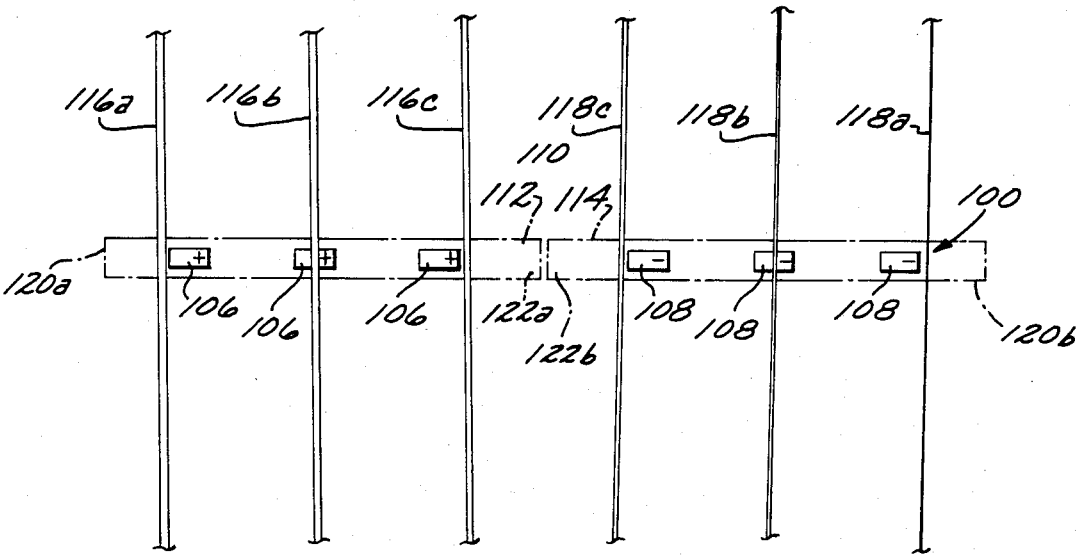
FIG. 18 is a fragmentary, diagrammatic top plan view of the form of the invention shown in FIG. 17.

FIGS. 17 and 18 diagrammatically illustrate a further and presently preferred embodiment of the invention which is characterized first by a novel split, two-section bridge saddle, second by novel extremely short piezoelectricl crystals associated with the respective strings, and third by novel transverse locating of the crystals relative to their respective strings.

The pickup module of FIGS. 17 and 18 is generally designated 100, and except for the sizes and locations of its piezoelectric crystal transducers, it preferably embodies the same basic structural arrangement as the pickup module 16*c* shown in FIGS. 10–16 and described in detail hereinabove. Accordingly, the features of the pickup module 100 that are novel over the prior art in general and over the other forms disclosed herein are simply illustrated diagrammatically in FIGS. 17 and 18 by showing the relative dimensions and locations of the split saddle, the strings of a six-string guitar, and the piezoelectric crystals.

The pickup module 100 is preferably provided in two sizes, one size being adapted to seat against the bottom of the slot of a conventional guitar bridge that is slotted to receive the traditional single-piece saddle that is approximately 0.080 to 0.090 inch thick, and the other size being adapted to seat against the bottom of the slot of a guitar bridge like the bridge 12*a* in FIGS. 12 and 13 that is slotted to receive a compensated saddle like the saddle 20 of FIGS. 12 and 13 that is approximately ¼ inch thick. The smaller size pickup module 100 is approximately 2-¾ inches long by 0.075 inch wide by 0.045 inch thick or high; while the larger pickup module 100 is also approximately 2-¾ inches long, but is approximately 0.240 inch wide by approximately 0.120 inch thick. Preferably, the smaller module 100 embodies a ground contact sheet 36*a* (FIGS. 11, 13 and 14) which is approximately 0.005 inch thick, while the large module 100 has a corresponding ground contact sheet 36*a* in the form of an aluminum plate approximately 0.080 inch thick. In FIGS. 17 and 18 the split saddle sections and piezoelectric crystals are shown approximately twice actual size for the smaller pickup module 100.

The pickup module 100 seats flush against the bottom surface 102 of the upwardly facing groove in a guitar bridge 104. The piezoelectric crystals are divided into two sets or groups of three crystals each, one set of three crystals 106 being located generally under the respective three consecutive strings at one side of the guitar, and the other set of crystals 108 being located generally under the respective three consecutive strings at the other side of the guitar. Three crystals 106 at one side all have the same polarity, designated plus for convenience, while the three crystals 108 at the other side also have the same polarity as each other, but opposite to the polarity of crystals 106 and designated minus for convenience. All of the crystals 106 and 108 are of the same size in every dimension, and since half of them has one polarity and the other half has the opposite polarity, the various types of microphonics are substantially completely canceled out in the pickup module 100, these including acoustic feedback, instrument body noises, cross feed and the like. While in the other forms of the invention previously described the consecutive crystals along the lengths (transverse to the strings) of the pickups had alternating polarities, applicant has found from extensive testing that in the pickup module 100 adapted for the split saddle, with the very short crystals, if consecutive crystals have alternating polarities, then the crystals cannot be spaced so as to get cancellation of microphonics without producing gross string response imbalance and without a considerable reduction of sensitivity.

The saddle is generally designated 110, and it is longitudinally split proximate its center into two slightly separated saddle sections 112 and 114 of substantially equal length. This split is substantially vertical as seen in FIG. 17, i.e., normal to the general plane of the top plate of the guitar; and is substantially longitudinal as seen in FIG. 18, i.e., in the longitudinal direction of the guitar or substantially parallel to the lengthwise direction of the strings. The three consecutive strings 116*a*, 116*b* and 116*c* at one side of the guitar are engaged over the saddle section 112, while the three consecutive strings 118*a*, 118*b* and 118*c* at the other side of the guitar are engaged over the other saddle section 114.

In the following description the term "outer" is employed to designate the region toward the outer ends 120*a* and 120*b* of the respective saddle sections 112 and 114, or toward the sides of the guitar; and the term "inner" is employed to designate the region toward the inner ends 122*a* and 122*b* of the respective saddle sections 112 and 114, or toward the transverse center of the guitar. With this terminology in mind, the three strings that are engaged over the saddle section 112 constitute an outer end string 116*a*, an inner end string 116*c*, and a center string 116*b*; while the strings engaged over the saddle section 114 constitute an outer end string 118*a*, an inner end string 118*c*, and a center string 118*b*. As seen in both FIG. 17 and FIG. 18, each of the outer strings 116*a* and 118*a* is transversely offset slightly outwardly of its respective crystal 106 and 108; while each of the inner strings 116c and 118c is transversely offset slightly inwardly from its respective crystal 106 and 108. On the other hand, each of the center strings 116b and 118b is generally transversely centered over its respective crystal 106 and 108. By this means, the outer strings 116a and 118a and the inner strings 116c and 118c have a poorer mechanical coupling with their respective crystals 106 and 108 than the center strings 116b and 118b have with their respective crystals 106 and 108. This enables accurate compensation to be effected against the tendency for there to be greater vibratory movement near the ends of each saddle section 112 and 114 than proximate the center of each saddle section 112 and 114, which, but for this compensation, would result in greater response to the end strings 116a, 116c, 118a and 118c than for the center strings 116b and 118b.

Applicant has found that with the strings thus transversely located over each of the two saddle half-sections 112 and 114 a substantially uniform response of the pickup to all six of the strings can be achieved without the need for any shimming. However, applicant has found that with a unitary saddle of the traditional type a uniform response to all of the strings cannot be achieved, even if some of the strings are transversely offset relative to the centers of the crystals in varying degrees, without the need for shimming. With a unitary saddle of conventional construction, regardless of how the crystals and strings are transversely arranged relative to each other, the two middle strings tend to be out of balance relative to the other strings due to the stiffness of the saddle structure, the rocking tendency of the unitary saddle causing greater vibratory movements of the saddle to be applied against the outer crystals.

Another important factor in achieving a balanced response of the pickup module 100 to all of the strings, and also an important factor in achieving a very high response of the pickup module 100 to compressional information transmitted from the strings through the saddle sections 112 and 114 to the respective crystals 106 and 108, is the extremely small size of each of the crystals 106 and 108, particularly in the lengthwise direction of the saddle 110 (the transverse direction relative to the longitudinal axis of the guitar).

While prior thinking was that the greater the crystal size, and particularly the greater its length in the longitudinal direction of the saddle, the greater its response characteristics. Applicant has found, to the contrary, that the greatest response is achieved with extremely short crystals. Thus, with crystals having a length in the longitudinal direction of the saddle 110 of not more than approximately 5/32 inch and preferably not more than approximately ⅛ inch, the response is increased more than 10 decibels (i.e., more than threefold) over traditional longer crystals. There appear to be several factors which synergistically contribute this large and unexpected increase in response for the very small crystals. One factor is that capacitive reactance is minimized. The longer the crystal, the greater the capacitive reactance that will dissipate electrical information generated in the crystals. Another factor is that the extremely short crystals effect almost a point contact such that the cancellation effects conventionally associated with the rolling or push-pull action resulting from horizontal, transverse string movements are substantially completely eliminated. A further factor which appears related to the higher performance characteristics of the very small crystals appears to be that the very short, almost point contact results in complete, substantially uniform compression over the entire area of each crystal, whereas as with relatively long crystals there is likely to be only a fraction of each crystal that is compressively actuated during operation.

This full area, substantially uniform compressive actuation of each of the very short crystals of the present invention is also a major factor in providing a very uniform response of the crystals to their respective strings, as compared to the responses of conventional longer crystals which may have different effective fractions of their respective areas fully operable due to variations in the manufacturing tolerances of the parts.

Applicant has found that both the amplitude of response and uniformity of response start to decline when the length of each crystal is greater than approximately ⅛ inch, and that this decline is to an undesirable extent when the length of each crystal is greater than approximately 5/32 inch, in the longitudinal direction of the saddle. While lengths less than ⅛ inch may provide good performance, the crystals then become increasingly less capable of withstanding the compressive forces to which they are subjected.

The thickness of the crystals in the vertical direction, i.e., between the bottom surface 102 of bridge 104 and the bottom surfaces of the saddle sections 112 and 114, is preferably not less than approximately 0.025 inch, and most preferably at least approximately 0.030 inch. As the thickness of the crystals drops below approximately 0.025 inch, the lesser amount of crystal material and the increasing capacitive reactance cumulatively cause deterioration of response; and also the crystals tend to become too fragile. Nevertheless, in each particular pickup module 100 uniformity of thickness of all of the crystals 106 and 108 is important in achieving uniformity of response to all of the strings.

Using the crystal mounting system shown and described in connection with FIGS. 10–16, the crystals 106 ahd 108 for the smaller pickup module 100 adapted for use with the split saddle 110 that replaces the traditional narrow saddle are preferably approximately 1/16 inch wide (in the thickness direction of the saddle 110 or longitudinal direction of the strings); and the crystals 106 and 108 for the larger pickup module 100 adapted for use with a split saddle 110 that replaces the conventional compensated saddle are preferably approximately ⅛ inch wide. The length of each of the crystals 106 and 108 in both the smaller and larger size pickup modules 100 is preferably approximately ⅛ inch, and the thickness preferably approximately 0.030 inch.

Thus for the smaller pickup module 100 the preferred crystal dimensions are approximately ⅛ inch long by approximately 1/16 inch wide by approximately 0.030 inch thick, while for the larger pickup module 100 the preferred crystal dimensions are approximately ⅛ inch long by approximately ⅛ inch wide by approximately 0.030 inch thick.

While the instant invention has been shown and described herein in what are conceived to be most practical and preferred embodiments, it is recognized that departures may be made therefrom within the scope of the invention, which is therefore not to be limited to the details disclosed herein, but is to be accorded the full scope of the appended claims.

I claim:

1. In a string instrument having a body with a generally flat upper portion and a plurality of strings spaced above and arranged generally parallel to said upper portion of the body of the instrument, a pickup which comprises:

a plurality of piezoelectric transducers spaced apart from each other and located generally between said plurality of strings and said upper portion of the body of the instrument and being responsive to compressional variations directed generally normal to said upper portion of the body of the instrument, each of said piezoelectric transducers having upper and lower parallel faces, the sum of the areas of all of said upper faces comprising an area of sensitivity substantially parallel to said upper portion of the body of the instrument, and string support means compressionally engaged between said plurality of strings and said plurality of piezoelectric transducers so as to apply compressional variations to said piezoelectric transducers in response to movements of said strings in said generally normal direction, whereby said piezoelectric transducers are sensitive to such generally normal string movements, substantially half of the total area of said area of sensitivity being electrically polarized in one direction, and substantially the other half of such total area being polarized in the opposite direction for cancellation of microphonics.

2. A pickup as defined in claim 1, which comprises six piezoelectric transducers located generally between six of said strings and the body of the instrument.

3. In a string instrument having a body with a generally flat upper portion and a plurality of strings spaced above and arranged generally parallel to each other and to said upper portion of the body of the instrument, a pickup which comprises:

a plurality of piezoelectric transducers arranged in an elongated array having a longitudinal axis generally parallel to said upper portion of the body of the instrument and generally transverse to said strings;

upwardly facing surface means on said upper portion of the body of the instrument upon which said transducers rest;

string support means compressionally engaged between said strings and said transducers so as to apply compressional variations to said transducers in response to movement of said strings; and transducer support means supporting said array of transducers in elongated, modular form, said transducer support means generally enclosing the tops, sides and bottoms of said transducers, and at least the upper portion of said support means above said transducers being pliable and thereby conformable to deformations in said string support means so as to provide substantially uniform responses of said transducers to said strings;

said transducer support means comprising an outer wrapping comprising electrically conductive metal foil;

said transducer support means comprising a body of flexible, electrically insulative material within which said piezoelectric transducers are located, said body having a plurality of cutout windows extending therethrough in the upward-downward direction and corresponding in number to the number of said transducers, each of said transducers being located in a respective said window;

said transducers each being generally flat, with upper and lower electrodes on opposite flat surfaces thereof which are generally parallel to said upper portion of the instrument body, said electrodes of each transducer being exposed on opposite sides of said pickup body, and elongated upper and lower electrical contacts of generally flat, electrically conductive sheet material engaged generally flat against the respective said upper and lower electrodes of said transducers, at least one of said contacts being electrically insulated from said outer wrapping.

4. A pickup as defined in claim 3, wherein said upper contact comprises metal foil.

5. A pickup as defined in claim 4, wherein said upper contact is a hot electrical contact and said lower contact is a ground electrical contact; and a coaxial cable leading from said pickup, said cable having an outer shield mechanically and electrically connected to said lower contact and inner conductor means extending upwardly through an aperture in said body and electrically connected to said upper contact.

6. A pickup as defined in claim 5, wherein said inner conductor means of said cable comprises a plurality of wire strands, said strands being compressed between said upper contact and said body.

7. In a string instrument having a body with a generally flat upper portion and at least four strings spaced above and arranged generally parallel to each other and to said upper portion of the body of the instrument, a pickup system which comprises:

a plurality of piezoelectric transducers corresponding in number to said number of strings arranged in an elongated array having a longitudinal axis generally parallel to said upper portion of the body of the instrument and generally transverse to said strings;

upwardly facing surface means on said upper portion of the body of the instrument upon which said transducers rest with each of said transducers lying generally under a respective one of said strings; and elongated saddle means arranged generally parallel to said elongated array of transducers and engaged between said strings and said transducers so as to mechanically compressionally couple each of said transducers to its respective said string whereby compressional variations are applied to each of said transducers in response to movement of its respective said string;

said saddle means being transversely split into two elongated sections to increase the uniformity of response of said crystals to their respective said strings, one of said saddle sections being engaged between one plural sequence of said strings and their respective said transducers, and the other of said saddle sections being engaged between another plural sequence of said strings and their respective said transducers.

8. A pickup system as defined in claim 7, wherein said strings are six in number, and each of said plural sequences comprises three strings.

9. A pickup system as defined in claim 8, wherein each of said plural sequences comprises an outer string, an inner string, and a center string between said outer and inner strings;

said center string in each of said plural sequences being more directly located over its respective said transducer than said outer and inner strings are over their respective said transducers to increase the uniformity of response of said crystals to their respective said strings in each of said plural sequences.

10. A pickup system as defined in claim 9, wherein each of said outer strings is located approximately over the outer edge of its respective said transducer, each of said inner strings is located approximately over the inner edge of its respective said transducer, and each of said center strings is approximately centrally located over its respective transducer.

11. A pickup system as defined in claim 7, wherein each of said transducers is not more than approximately 5/32 inch long in the longitudinal direction of said array.

12. A pickup system as defined in claim 11, wherein each of said transducers is not less than approximately 0.025 inch thick in the direction generally normal to said upper portion of the body of the instrument.

13. A pickup system as defined in claim 7, wherein each of said transducers is not more than approximately ⅛ inch long in the longitudinal direction of said array.

14. A pickup system as defined in claim 13, wherein each of said transducers is not less than approximately 0.030 inch thick in the direction generally normal to said upper portion of the body of the instrument.

* * * * *